United States Patent [19]

Heiberger

[11] 4,041,648

[45] Aug. 16, 1977

[54] TUMBLING AND POLISHING MACHINE WITH PLANETARY ROTATING DRUMS

[76] Inventor: Ernst Heiberger, Winzingerstrasse 13, 7321 Reichenbach, Rechberg, Germany

[21] Appl. No.: 691,063

[22] Filed: May 28, 1976

[30] Foreign Application Priority Data

June 3, 1975 Germany ..... 2524566

[51] Int. Cl.[2] ..... B24B 31/02

[52] U.S. Cl. ..... 51/164; 259/57

[58] Field of Search ..... 259/3, 57; 51/164

[56] References Cited

U.S. PATENT DOCUMENTS

| | | | |
|---|---|---|---|
| 1,011,929 | 12/1911 | Ecaubert | 259/57 |
| 3,579,920 | 5/1971 | Heiberger | 51/164 |
| 3,679,184 | 7/1972 | Halliday | 259/57 |

*Primary Examiner*—Harold D. Whitehead
*Attorney, Agent, or Firm*—Sughrue, Rothwell, Mion, Zinn and Macpeak

[57] ABSTRACT

An apparatus for abrasive tumbling or polishing with rotary-driven drums, mounted in a planetary rotational movement on two rotary-driven disks which face one another, the drums being mounted between the disks, the disks being supported by a fixed stand. The bearings in the carrousel disk on the feed-opening side of the drums being in contact with the perimeter of the drums. The disks are disposed at an angle to the vertical and have inclined walls.

7 Claims, 1 Drawing Figure

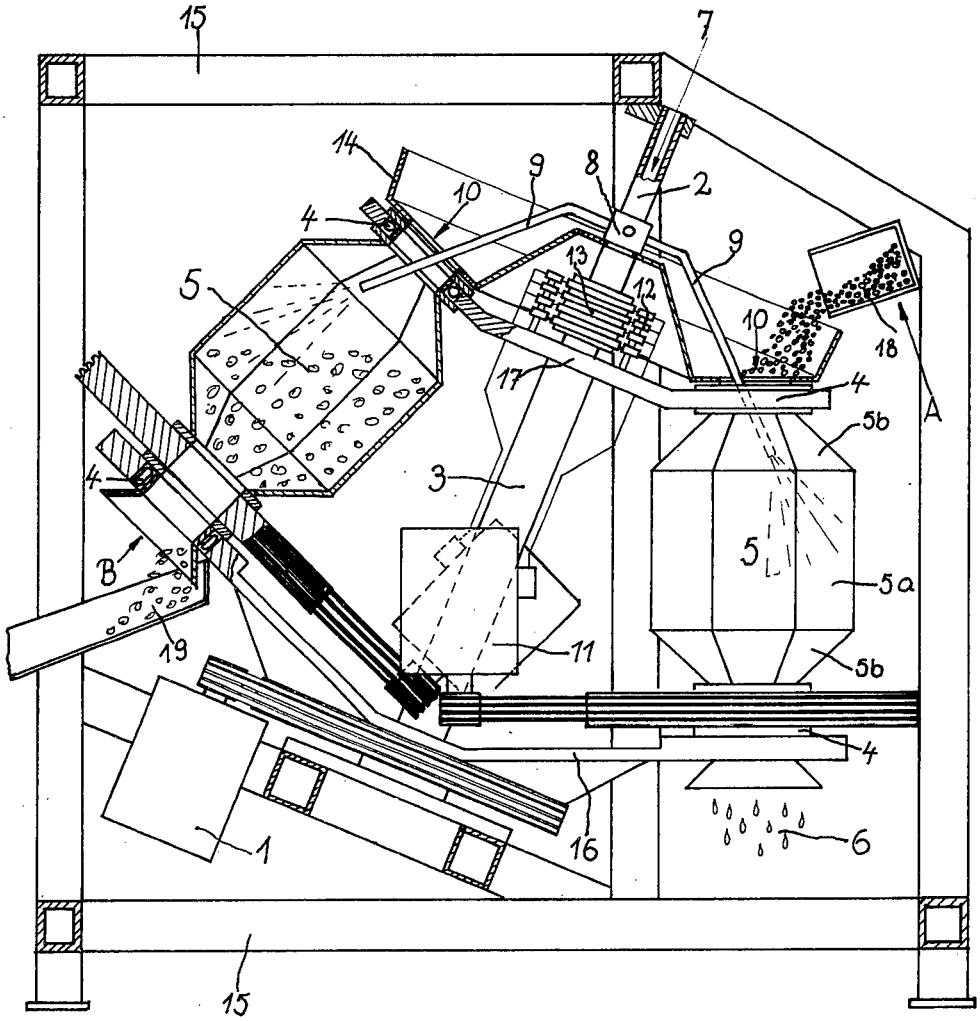
15
7
14
9
8
2
10
4
9
13
12
5
10
18
A
17
4
5b
4
3
5
B
5a
19
11
5b
4
16
6
1
15

TUMBLING AND POLISHING MACHINE WITH PLANETARY ROTATING DRUMS

BACKGROUND OF THE INVENTION

Tumbling and polishing machines are known in the art. In German Patent 1,652,065, for example, the carrousel disks are flat plates; the drums are arranged parallel to one another and are rotated about the axis of the carrousel disks in a stationary frame with a fixed angle of inclination to the vertical or to the horizontal. This fixed angle of inclination of the drums leads in many cases to unsatisfactory results in the known machine, the frame supporting the carrousel disks is suspended in a fixed stand and swivel-mounted about an axis running vertically to the axis of rotation of the carrousel disks, there being a gimbal suspension of the carrousel disks as a whole. Thus, by a swivel movement of the frame, the drums can be set into a tumbling motion during their rotation. Although this type of suspension facilitates the emptying of the drums, it is very complicated and susceptible to breakdown, particularly since, during operation, the rotating carrousel is never completely balanced. Additionally, the drive of the entire apparatus poses difficult problems. Either the drive of the carrousel must be carried out on gimbals, which leads to irregularities in the course of motion when the frame carrying the carrousel is swivelled, or the driving motor for the carrousel must be mounted in a swivel frame and moved together with the carrousel. The motor for the drums must, of necessity, be positioned in one of the carrousel disks, so that the motor as well must be moved in the swivel motion. The mass to be swivelled is thus relatively great and must be supported by all the bearings. The tumbling motion, which is necessary in order to attain a good polishing effect, makes it moreover impossible to fill or empty the drums while in operation.

SUMMARY OF THE INVENTION

According to the invention, this object is solved in that the carrousel disks are generally cup-shaped, the side walls of the "cup" being inclined at a certain angle to the floor. The axis of rotation of the disks is stationary and so inclined from the vertical that the drum, mounted on the wall of the "cup", will be vertical when the drum is in its lowest position during its rotational movement; that is, the angle between said walls and said floor corresponds to the angle of inclination of the floor of the disks. The bearings in the lower carrousel disk are in contact with the periphery of the drum, and the drums are openable at their lower front ends.

Preferably, the cup-shaped carrousel disks are three-dimensional polygons, and, as mentioned, the angle of inclination of the side walls carrying the drums to the axis of rotation of the carrousel disks is chosen to correspond to the inclination of the said axis of rotation. In the lowest position, the side walls of the carrousel disks carrying the drums are horizontal. The inclination to the vertical of the axis of the carrousel disks is preferably about 22°, so that in the uppermost position the drums are tilted approximately 44° from the vertical. If each drum comprises a prismatic central section with two attached frustum-shaped end sections, whose aperture angle is about 90°, then the drums can be safely emptied even in their uppermost position.

By means of this invention, due to the tilt of the carrousel axis and the inclination between the drums and the carrousel axis, a sinusoidal rotation of the filling material is achieved. This rotation allows one to attain a good abrading or polishing effect. Since the carrousel axis is stationary, the feeding device and the discharging device can be in a fixed position, which makes it easily possible to fill and empty the drums, even during operation. The carrousel can be stopped for a short time whilst all the drums continue to rotate. It is thus possible, in an apparatus equipped with several drums, to regulate the treatment times individually for each drum, since during the filling and emptying of individual drums the polishing process in the other drums need not be interrupted.

It is an object of the present invention to provide a tumbling machine of the general type explained above, in which at least as good results can be obtained on the treated material with a much simpler construction. It is a further object to provide an apparatus which can also be filled and emptied while in operation.

The invention and further advantageous embodiments thereof are described in greater detail below, with reference to the drawing.

DETAILED DESCRIPTION OF THE DRAWING

The drawing shows a frame 15, in which a fixed axis 2 is disposed at an inclination of about 22° to the vertical. The axis 2 carries a hub 3, which is driven by a fixed motor 1, which may be an electric motor, a hydraulic motor, a pneumatic motor, etc. Attached to the hub 3 are two carrousel disks 16 and 17, which are cup-shaped, and in the present case frustum-shaped. The angles of inclination of the side walls of the carrousel disks 16 and 17 which carry the drums 5 to the floors of the disks are so selected that in the lowest position the drums 5 are upright, i.e. the corresponding side wall lies in a horizontal position, as is shown in the drawing for the righthand drum. In the preferred embodiment the carrousel disks carry four drums, two of which are shown, one in cross-section.

The drums 5 are mounted in the side walls of the carrousel disks 16 and 17 on both sides in such a way that the bearings 4 in the carrousel disks 16 and 17 only act on the perimeter of each drum. In this way, the front ends of the drums 5 are freely accessible, whereby material can be conveniently removed or added. Each drum 5 is driven by its own motor 11, which is attached to the carrousel hub 3. The motors 11 may be of the same type as the motor 1; in the preferred embodiment they are electric motors, power being supplied by means of rotating brushes 12 and stationary slip-rings 13.

The drums 5 are of a polygonal construction, with a prismatic central section **5*a* and two frustum-shaped end sections 5*b*. The prismatic end sections 5*b* have an aperture angle of about 90°, so that with the prevailing angle of inclination of the shaft 2**, even in the uppermost position of a drum, as is drawn on the left, the drums can be completely emptied. The prismatic form of the drums helps the rotatory flow of the material being treated in the drums.

Above, the upper carrousel disk 17 is a filling channel 14 which runs in a circle concentrically with the carrousel axis 2. The filling channel 14 is arranged in one continuous piece above the drums and has an opening opposite the feed opening of each drum, with which to fill the drum beneath. On side A, a filling device 18 is provided, which opens out into the filling channel 14. The feed openings of the drums 5 are open while the machine is running. This possibility eliminates the danger of covers being blown off by steam formation during high-proficiency grinding, as is often the case with other systems. Due to the minimal tilt and the special form of the drums, even when the drums are almost completely full it is virtually impossible for the contents to leak out. The presence of the filling channel 14 has the advantage that when filling, the drum to be filled need not be aligned exactly underneath the filling device 18, since the filling channel 14 acts as a funnel and directs the filling material safely into the drum concerned.

The simple construction of the apparatus makes it possible to provide it with liquid delivery pipes 9, carried by a distributor 8, which rotates together with the carrousel. The distributor is supplied with liquid, for instance fresh water, through the end 7 of the hollow driving shaft 2. In this way it is possible to add rinsing water continuously during operation. The provision of appropriate perforations in the base of the drums 5 prevents the drums from overflowing. At 6, drops of water emerging from the right-hand drum 5 are represented.

At B on the left of the drawing, a discharge spout 19 is provided, into which the contents of the drum can be drawn off after opening a cover on the base of the drum, preferably perforated, which is not shown here. This discharge spout 19 is situated on the opposite side of the machine from the filling device 18; in the present case, in the highest position which an individual drum can occupy.

What is claimed is:

1. In a tumbling and polishing machine including several planetary rotating drums for processing the surfaces and edges of workpieces by means of abrasive bodies in the drums, said drums comprising rotatable, driven, front end loading drums, means for mounting said drums on a rotor comprising two axially spaced discs, means for rotating said discs about a rotor axis on a fixed frame, the improvement characterized in that the rotating axes of the drums are inclined in the direction of their upper ends towards the rotation axis of the rotor, and the rotation axis of the rotor is inclined from the vertical such that the axes of the drums in the lowest position at any given time is approximately vertical, and wherein the drums are provided at their lower ends with an openable base door for emptying the drums and are apertured for the outflow of treatment and rinsing fluids.

2. The machine according to claim 1, characterized in that the inclination of the fixed rotation axis of the rotor to the vertical is approximately 22°.

3. The machine according to claim 1, further characterized in that an annular charging chute is disposed parallel to the upper rotor disc and above the permanently open filling apertures of the drums, coaxial to the rotation axis of the rotor, and said machine is provided in the region of the filling apertures of the drums with openings for the passage of the filling material.

4. The machine according to claim 1, further comprising conduits for the supply of treatment and rinsing fluids to the drum contents connected to a distributing head of the rotor for discharge into the inner space of the drums.

5. The machine according to claim 1, wherein the base doors of the drums are provided with perforated plates.

6. The machine according to claim 1, wherein at the highest point of the drum trajectory, a discharge spout is arranged under the lower rotor disc.

7. The machine according to claim 1, wherein the drums are driven individually by motors attached to the rotor.

* * * * *